US010495315B2

(12) United States Patent
DeMars et al.

(10) Patent No.: US 10,495,315 B2
(45) Date of Patent: Dec. 3, 2019

(54) EGG SHAPED BARBEQUE GRILL

(71) Applicant: Original Ideas, Inc., San Clemente, CA (US)

(72) Inventors: Robert DeMars, San Clemente, CA (US); Alan Crawford, Burbank, CA (US); Takuya Idehara, South Pasadena, CA (US); Jim Keen, Thousands Oaks, CA (US); Spencer Mackay, Agoura Hills, CA (US)

(73) Assignee: ORIGINAL IDEAS, INC., San Clemente, CA (US)

( * ) Notice: Subject to any disclaimer, the term of this patent is extended or adjusted under 35 U.S.C. 154(b) by 0 days.

(21) Appl. No.: 15/479,158

(22) Filed: Apr. 4, 2017

(65) Prior Publication Data

US 2018/0187895 A1 Jul. 5, 2018

Related U.S. Application Data

(60) Provisional application No. 62/441,850, filed on Jan. 3, 2017.

(51) Int. Cl.
*A47J 37/00* (2006.01)
*F24B 3/00* (2006.01)

(52) U.S. Cl.
CPC ..... *F24B 3/00* (2013.01)

(58) Field of Classification Search
CPC .. A47F 5/05; A47F 5/02; A47F 5/0087; A47F 5/10; A47B 46/00; A47B 49/00; A47B 96/02; A47B 96/025; A47J 37/1257; A47J 37/0814; F24C 15/16; F24C 15/02; F24C 15/022; F24C 15/162; F24C 15/18
See application file for complete search history.

(56) References Cited

U.S. PATENT DOCUMENTS

| | | | | |
|---|---|---|---|---|
| 3,008,680 | A * | 11/1961 | Hoffman | A47B 21/045 211/144 |
| 5,865,099 | A | 2/1999 | Waugh | |
| 5,906,193 | A | 5/1999 | Leach et al. | |
| D463,196 | S | 9/2002 | Hsu | |
| 6,568,546 | B1 * | 5/2003 | Huang | A47B 49/00 211/205 |
| 9,237,828 | B2 | 1/2016 | Walters et al. | |
| 9,380,910 | B1 | 7/2016 | Noel | |
| 2006/0054158 | A1 | 3/2006 | Nash | |

(Continued)

FOREIGN PATENT DOCUMENTS

CN 201379069 Y * 1/2010

*Primary Examiner* — Jason Lau
(74) *Attorney, Agent, or Firm* — Cislo & Thomas, LLP

(57) ABSTRACT

A light-weight, egg shaped charcoal grill is presented. The charcoal grill features a grill assembly and a cart. The grill assembly comprises a double walled lid, main body and ash pan, wherein the lid is hingedly connected to the main body and the ash pan is detachable from the main body. The grill assembly features adjustable upper and lower air vents located in the lid and ash pan, respectively, as well as a temperature sensor in the lid. The grill assembly further includes shelves which are rotatable about the perimeter of the grill assembly and which may also be moved from a working position parallel to a ground surface to a folded position perpendicular to the ground surface, for storage.

14 Claims, 13 Drawing Sheets

(56) References Cited

U.S. PATENT DOCUMENTS

| | | | | |
|---|---|---|---|---|
| 2009/0308373 | A1* | 12/2009 | Scott | A47J 36/06<br>126/25 R |
| 2010/0258105 | A1 | 10/2010 | Simms | |
| 2011/0283990 | A1* | 11/2011 | Walters | A47J 37/0704<br>126/25 R |
| 2015/0041421 | A1* | 2/2015 | Duke | A47B 5/00<br>211/150 |
| 2016/0029840 | A1 | 2/2016 | Walters et al. | |

* cited by examiner

EGG SHAPED BARBEQUE GRILL

CLAIM FOR PRIORITY

This application claims priority from U.S. Provisional Application Ser. No. 62/441,850 entitled "Egg Shaped Barbeque Grill," filed on Jan. 3, 2017, the contents of which are incorporated herein, in their entirety.

BACKGROUND OF THE INVENTION

Field of the Invention

The present invention relates generally to the art of barbeque grills and more particularly to a generally egg shaped barbecue grill intended for use with charcoal fuel.

Background of the Invention

Many different types of barbeque grills are known for use in cooking meats and other types of food. These grills can generally be divided into two types: gas-fueled grills and charcoal grills. Gas fueled grills commonly use liquid propane or natural gas as the primary fuel for cooking food over gas burners. Is contrast, charcoal grills are configured to hold and burn charcoal to generate heat for cooking food. Of these two grill types, charcoal grills are widely regarded by grilling enthusiasts as imparting the best flavor to foods. Charcoal grills are commonly available in a variety of configurations including, for example, kettle style grills, barrel style grills and egg shaped or kamado style grills.

The kamado style grill which has its origins in Asian earthenware cooking urns has become quite popular in recent years. Existing designs however are often of ceramic construction and are relatively heavy and difficult to maneuver with existing grill stands. Such grills also lack amenities such as removable ash pans and easily reachable shelves for holding grilling utensils and/or foods to be cooked.

What is needed therefore is a new kamado or egg shaped grill design that is lighter than prior art designs and can therefore be mounted in a cart that is easily maneuverable. It would also be desirable if such a grill included movable shelving that could be readily positioned about the grill as desired by a user. It would further be desirable if the shelving was foldable for convenient storage when the grill is not in use.

SUMMARY OF THE INVENTION

The present invention charcoal grill solves the problems of the prior art by providing a grill assembly of sheet metal construction that is substantially lighter than a ceramic grill design. The relatively light-weight grill assembly of the present invention also features multi-position, foldable shelves that are rotatable about a perimeter of the grill assembly and further includes a maneuverable light weight cart to support the grill assembly.

The grill assembly comprises a lid, a main body and an ash pan which are arranged in an egg shaped configuration, i.e. the volume of the lid is substantially greater than that of the ash pan and sides of main body taper inwardly from the top to the bottom of the main body. This configuration is believed to provide a functional advantage in that more heat is retained in the lid of the grill and ash is easily collected in the removable ash pan. The lid is hingedly attacked to the main body and the ash pan is removably attached to the main body via a pin and catch system. The lid, main body and ash pan are of double wall, sheet metal construction having an outer shell and an inner shell with a cavity or space between the shells. The cavities between the shells of the lid, main body, and the ash pan may be filled with an insulative material to improve heat retention in the grill assembly.

The grill assembly also includes an upper vent disposed in the lid and a lower vent disposed in the ash pan. The upper and lower vents have adjustable air flow openings which serve to control air flow through the grill during use. The grill also features a removable fire bowl disposed within the inner shell of the main body. The fire bowl has provisions for supporting a charcoal grate at a lower end of the bowl and a cooking grate at an upper end.

The grill assembly further includes a circumferential band about the perimeter of the main body. The circumferential band includes upper and lower recesses or tracks which engage upper and lower flanges of a shelf assembly. This arrangement allows the shelves of the grill to be circumferentially rotatable about the band. The cart which accompanies the grill assembly has a curved interior support surface which supports the grill assembly along a curved portion of the main body.

The above and other advantages of the charcoal grill assembly and cart of the present invention will be described in more detail below.

DETAILED DESCRIPTION OF THE PREFERRED EMBODIMENTS

Figure 1:
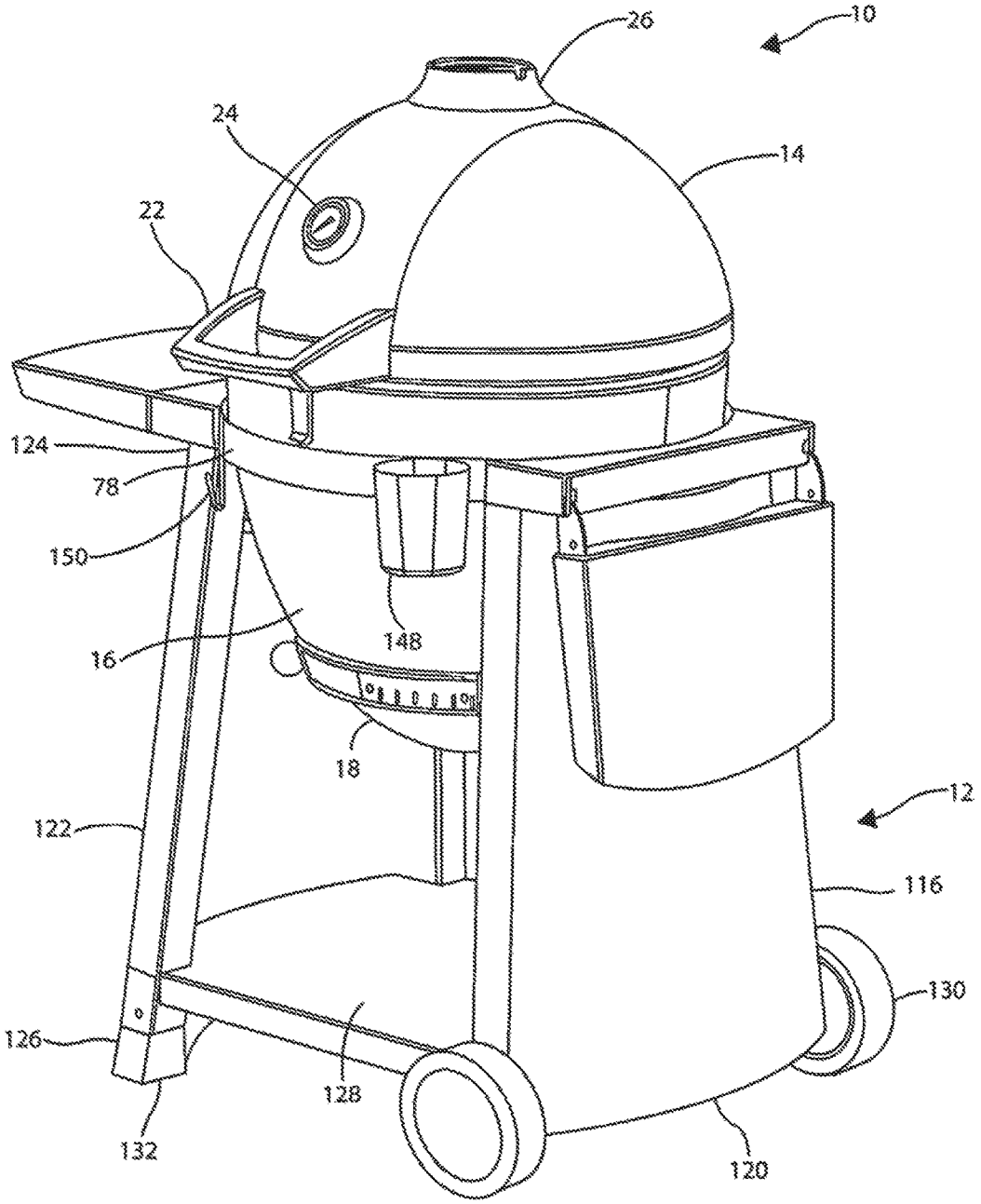
FIG. 1 a front perspective view of the egg shaped grill assembly and cart of the present invention.
Figure 2:
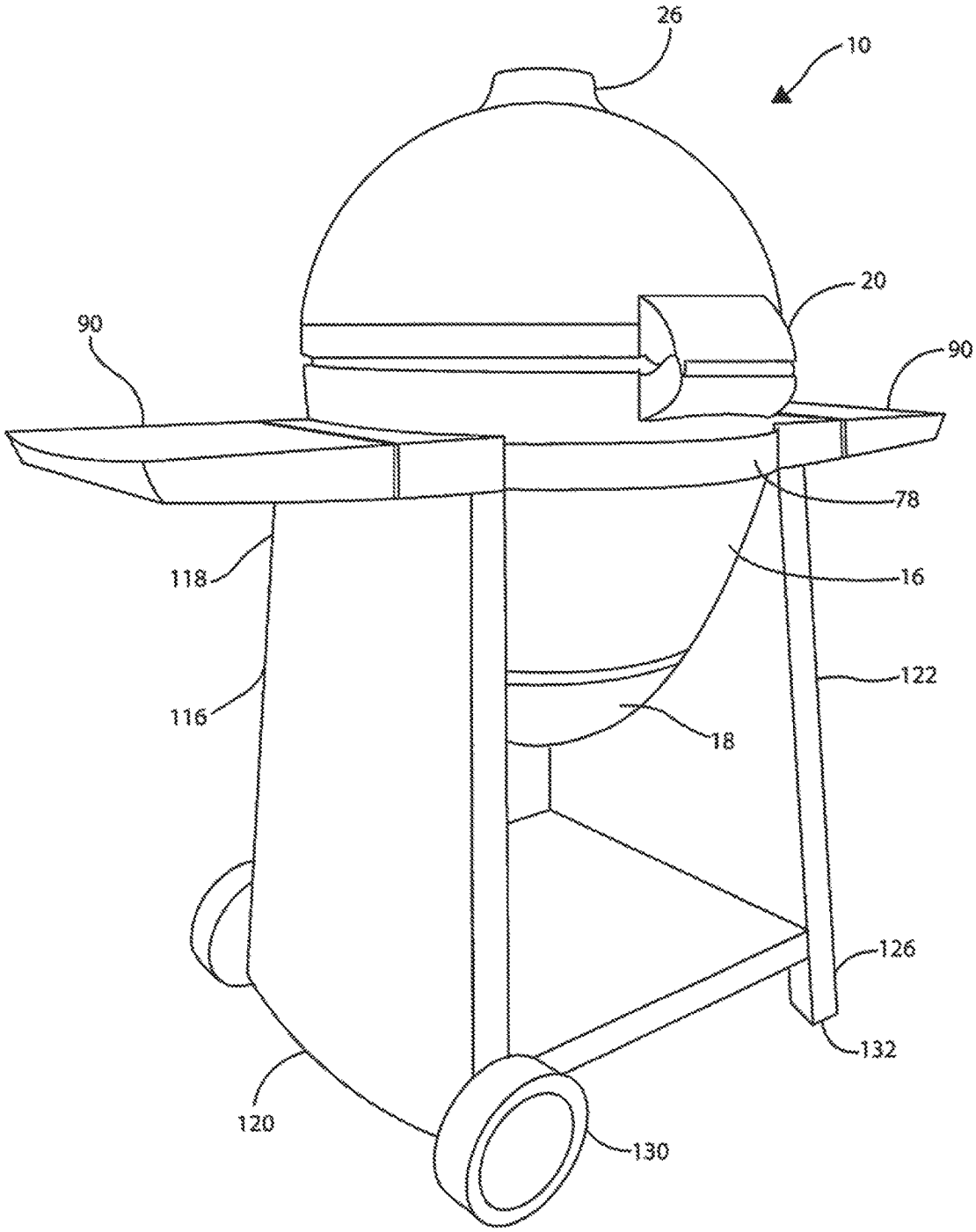
FIG. 2 is a rear perspective view of the egg shaped grill assembly and cart of the present invention.
Figure 3:
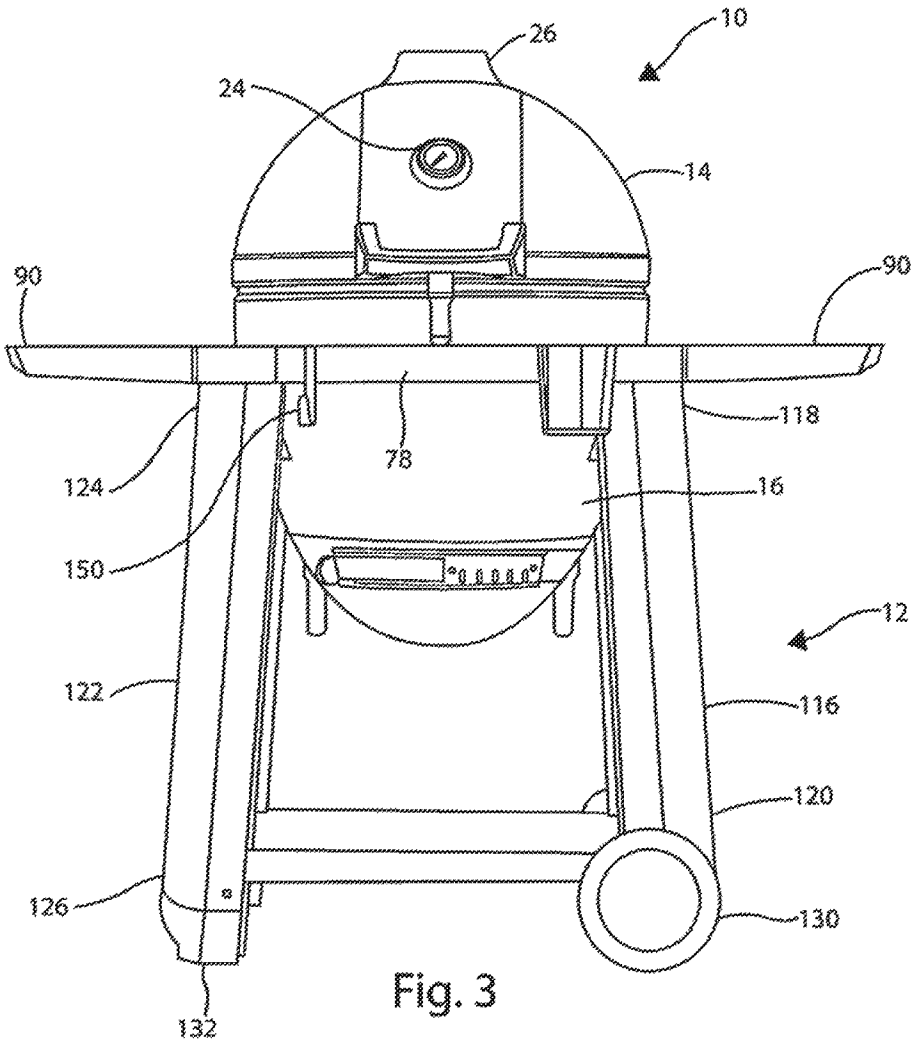
FIG. 3 is a front view of the egg shaped grill assembly and cart of the present invention.

The present invention will now be described more fully hereinafter with reference to the accompanying drawings, in which preferred embodiments of the invention are shown. The invention may, however, may bee embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

With reference to FIGS. 1-5, the present invention comprises a charcoal grill assembly 10 and a cart 12. The overall appearance of the grill assembly 10 is generally egg shaped. The grill assembly 10 includes a domed lid 14, a main body 16, and an ash pan 18, wherein these components are configured in the shape of an egg, i.e. the lid 14 is of substantially greater volume that the ash pan 18 and the main body 16 tapers from a large diameter at the main body 16 to lid 14 interface to a smaller diameter at a main body 16 to ash pan 18 interface. In a preferred embodiment, the volume of the lid 14 and main body 16 combined, is three (3) times greater than that of the ash pan 18. This configuration is believed to provide a fractional advantage to that more heat is retained in the lid 14 of the grill assembly 10 and ash is readily removed from grill assembly 10 by removal of the removable ash pan. The domed lid 14 is connected to the main body 16 at a rear end of the main body by a hinge 20, (see FIG. 2), and is operable between an open position and a closed position by means of a handle 22 attached to a front portion of the lid 18. Incorporated in the lid 18 is a temperature sensor 24 and an upper air outlet vent 26, which has adjustable air outlet openings 28.

Figure 14:
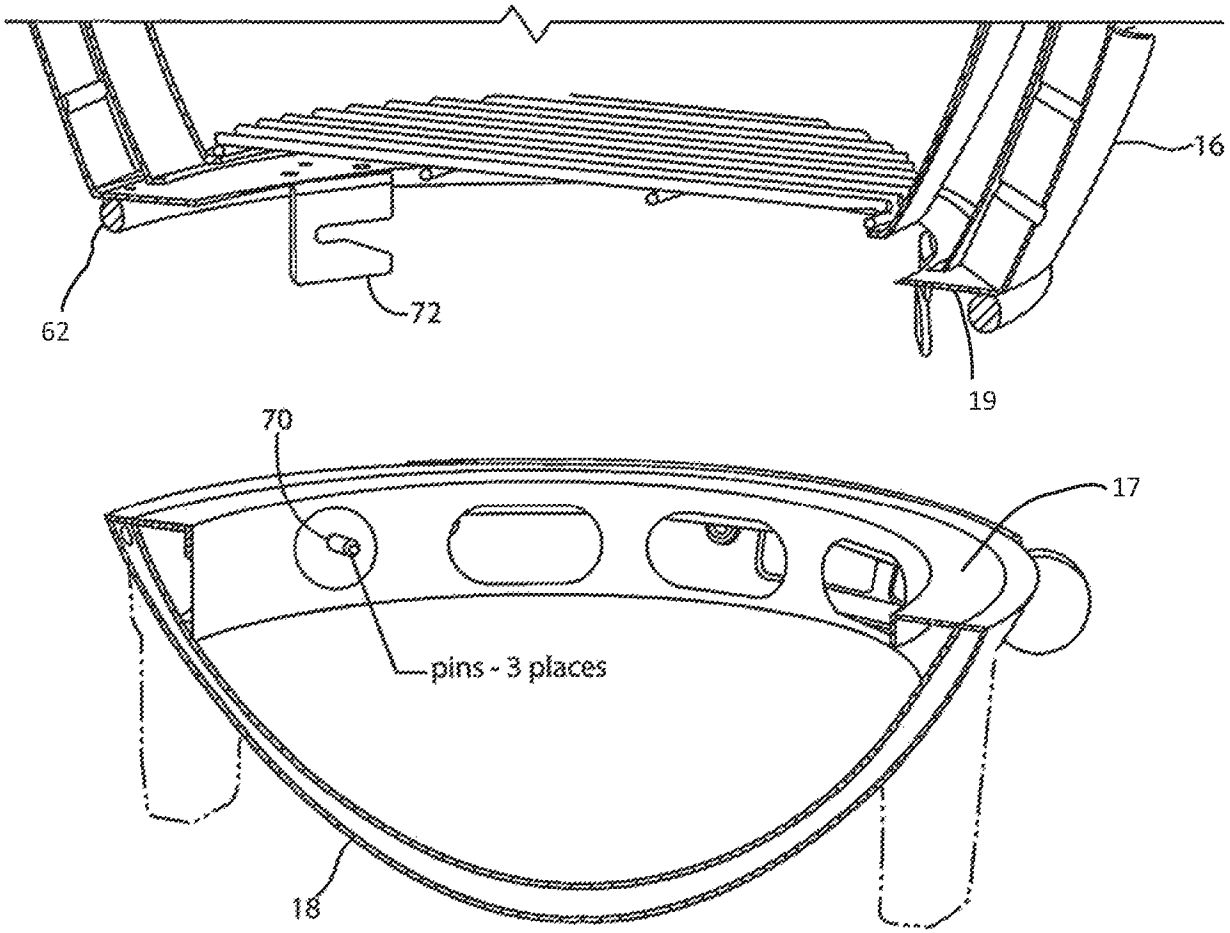
FIG. 14 is a partial cutaway perspective view of the egg shaped grill of the present invention showing the ash pan detached from the fire bowl.
Figure 15:
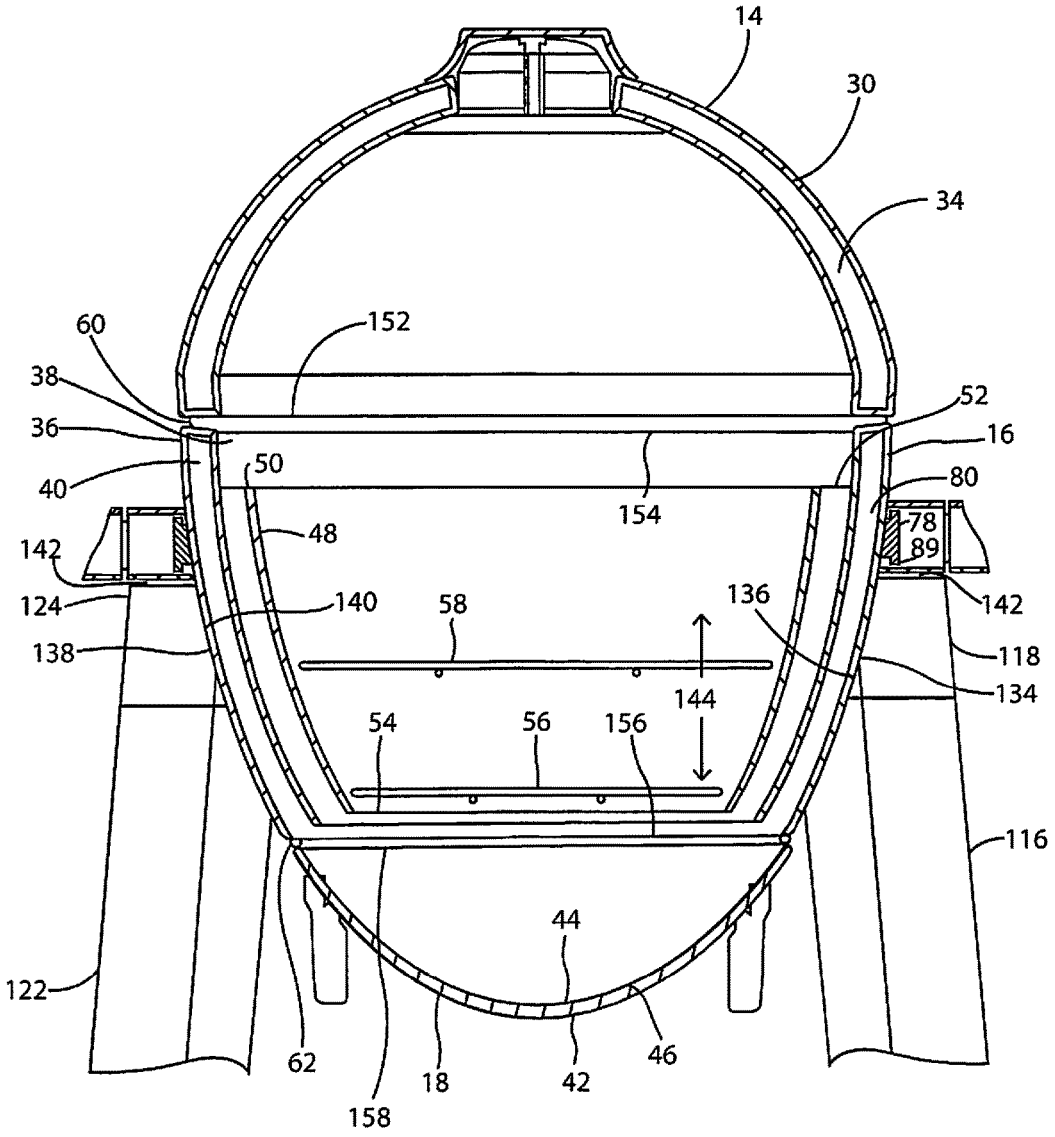
FIG. 15 is a partial cross-sectional view of the egg shaped grill of the present invention.

With reference to FIG. 15, the lid 14 has an outer shell 30, an inner shell 32 with a cavity 34 formed therebetween and a generally circular opening 152. Similarly, the main body 16 has an outer shell 36, an inner shell 38, a cavity 40 formed therebetween, and a generally circular upper opening 154 and a generally circular lower opening 156. Likewise, the detachable ash pan 18 has an outer shell 42, an inner shell 44, a cavity 46 formed therebetween and a generally circular opening 158. The double wall construction of the lid 14, main body 16 and ash pan 18 provides for excellent heat retention without the weight of a typical ceramic kamado style grill. The cavities 34, 40 and 46 in the lid 14, main body 16 and detachable ash pan 18 may optionally be filled with an insulative material such as fiberglass for improved heat retention. The ash pan 18 includes a ring shaped upper surface 17 and the main body 16 includes a ring shaped lower surface 19, wherein the ring shaped lower surface 19 of the main body 16 interfaces with the ring shaped upper surface 17 of the ash pan 18 by means of a seal 62. (See FIG. 14.)

With reference to FIG. 15, the grill assembly 10 further includes a removable fire bowl 48 which is disposed within the inner shell 38 of the main body 16. The removable fire bowl 48 will typically be formed with an upper lip 50 which allows it to be supported by means of a ledge 52, which is attached to the inner shell 38 of the main body 16 by means of brackets (not shown). Alternatively, the fire bowl 48 may be supported directly by brackets or pins attached to the inner shell 38 or other like fastening means. At a bottom of the fire bowl 48 is a ledge or lip 54. The lip 54 serves to support a solid feel fire grate 56. Typically, the solid fuel used with the grill assembly 10 would be charcoal, however other solid fuels such as wood, are also suitable. The fire grate 56 may readily be removed from the fire bowl 48 if desired. A food cooking grate 58 is also disposed within the fire bowl 48. The food cooking grate 58 is supported by brackets or pins (not shown) or like supports and is also removable from the fire bowl 48.

With reference to FIGS. 1-5 and 14-15, the main body 16 is equipped an upper seal 60 and a lower seal 62. The upper seal 60 serves to prevent air from entering the fire bowl 16 at the fire bowl to lid 18 interface, when the lid 18 is closed and the lower seal 62 likewise serves to prevent air from entering the main body 16 at the main body 16 to ash pan 18 interface. The main body 16 and lid 18 are equipped with a latch assembly 64 which allows the lid 18 to be latched to the main body 16 in a closed position when the charcoal grill assembly 10 is in use or during storage.

Figure 4:
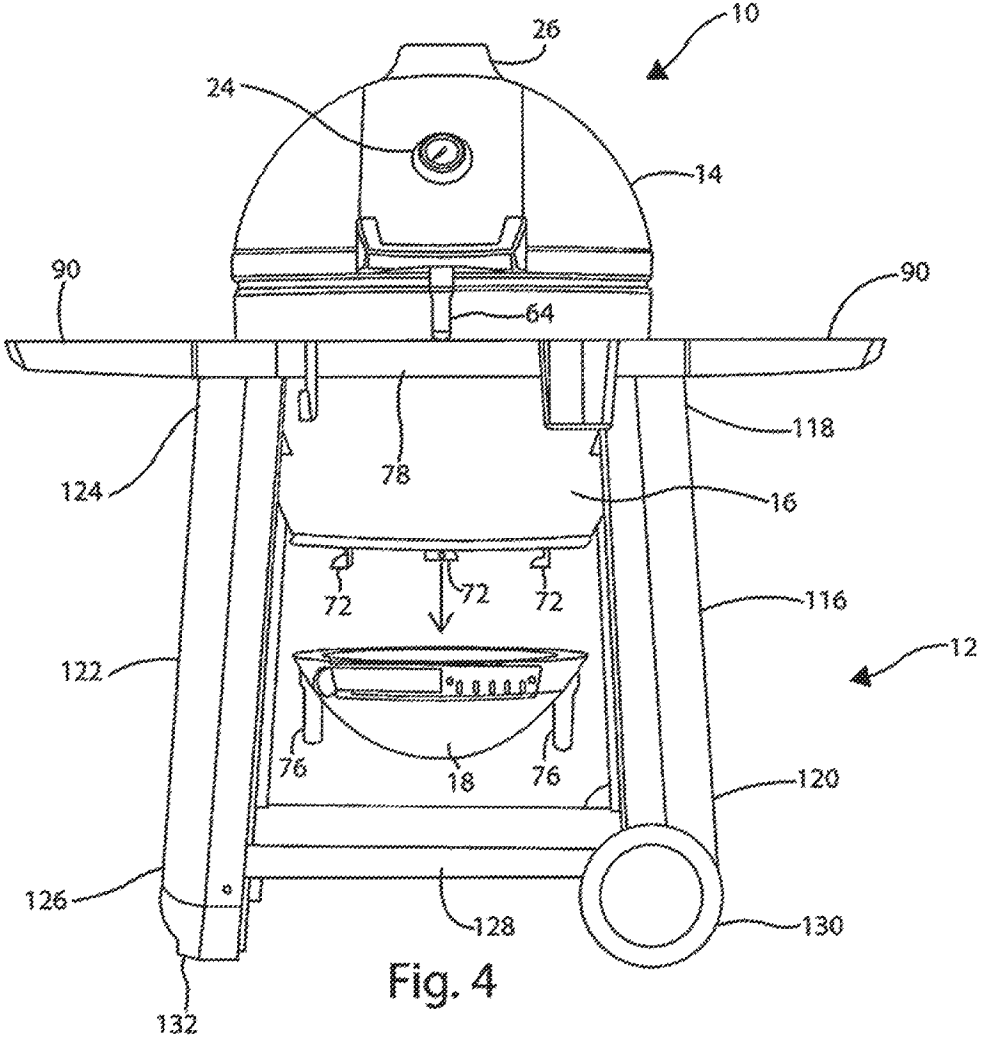
FIG. 4 is a front view of the egg shaped grill assembly and cart of the present invention showing the ash pan separated from the grill.
Figure 5:
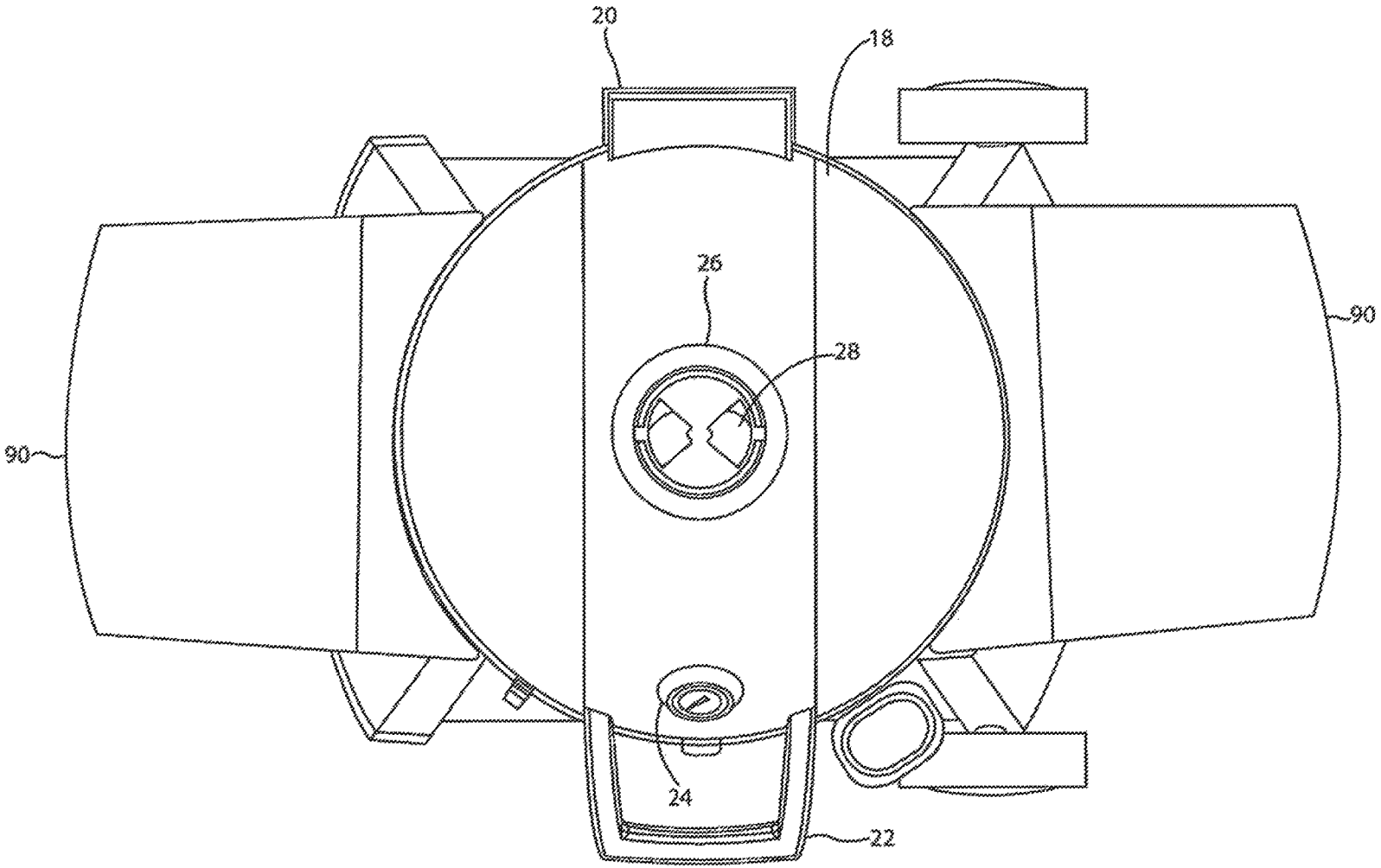
FIG. 5 is a top view of the egg shaped grill assembly and cart of the present invention.

With reference to FIGS. 4 and 14, the ash pan 18 is shown in more detail. The ash pan 18 includes an air intake vent 66 which has an adjustable air opening 68. The ash pan 18 is removably attachable to the main body 16 via pins 70 attached to the ash pan 18 and catches 72 attached to the main body 16. The pins 70 and associated catches 72 are located at three points about the ash pan 18 and main body 16, respectively. To remove the ash pan 18, handles 76, attached to the ash pan 18 are grasped by a user and the ash pan 18 is rotated counterclockwise which causes the pins 70 to drop out of the catches 72 of the main body 16. The reverse procedure is used to attach the ash pan 18 to the main body 16, i.e. the ash pan 18, via the handles 76, is rotated clockwise such that the pins 70 of the ash pan 18 engage the catches 72 of the main body 16.

When the charcoal grill assembly 10 is in use, charcoal initially resting upon the fire grate 56 will be consumed and the resulting ash will collect in the ash pan 18, which requires that the ash pan 18 be removed from the main body 16 and the ashes removed from time-to-time.

Generally, the lid 14, main body 16, ash pan 18 and fire bowl 48 of the grill assembly 10 are formed from sheet metal and protected from corrosion with a baked enamel, powder coated or ceramic finish. Stainless steel and other metallic materials are also suitable for these components. Likewise, the vents and grates will typically be made from steel, stainless steel, cast iron or other metallic materials.

With reference to FIGS. 1-4, 12, 13 and 15, the main body 16 is fitted with a circumferential band 78 about a perimeter 80 (see FIG. 15) of the main body 16. The circumferential band 78 includes an outer surface 82 and an inner surface 84. The inner surface 84 is curved to conform to the curvature of the main body 16. The outer surface 82 has a first height and the inner surface 84 has a second, lesser height. The difference between the first and second heights creates a circumferential upper recess or track 86, corresponding to a circumferential upper lug 87, and a circumferential lower recess or track 88, corresponding to a circumferential lower lug 89, in the circumferential band 78. The circumferential upper and lower recesses or tracks 86 and 88, and corresponding upper and lower lugs 87 and 89, provide an interface between the circumferential band 78 and the rotatable (about the perimeter of the main body 16) shelf assembly 90. In the exemplary embodiment, the support band 78 is fabricated from stainless steel, however other metallic materials are also suitable. The grill assembly 10 is equipped with at least one shelf assembly 90 and typically, two shelf assemblies 90.

With reference to FIGS. 7-11, a shelf assembly 90 comprises an attachment portion 92 and a shelf portion 94. The attachment portion 92 includes a circumferential upper flange or channel 96 and a circumferential lower flange or channel 98. The shelf assembly 90 attaches to the circumferential band 78 of the grill assembly 10 such that the circumferential upper flange or channel of the base portion 92 of the shelf assembly 90 is fitted over the circumferential upper lug 87 and into the upper recess 86 of the support band 78. Likewise, the circumferential lower flange or channel 98 of the base portion 92 of the shelf assembly 90 is fitted over the circumferential lower lug 89 and into the lower recess 88 of the support band 78. Via this configuration, the shelf assembly 90 is rotatable circumferentially about the circumferential band 78. The shelf assembly 90 will typically be made from a tough and durable thermoplastic of which many are known in the art. Other materials may also be suitable.

In an alternative embodiment, the shelf assembly 90 may be equipped with only the circumferential upper flange or channel 96. This alternative embodiment provides for potentially easier shelf installation, with the possible drawback of less shelf stability when installed.

With reference to FIGS. 8-11, the base portion 92 of the shelf assembly 90 has an upper slot 100 and a lower slot 102. The upper slot 100 is of an irregular shape and features an upper detent or lock position 104 and a lower detent or lock position 106. The lower slot 102 is a horizontal slot with a front end point 108 and a rear end point 110. The shelf portion 94 of the shelf assembly 90 is equipped with an upper pin 112 and a lower pin 114.

Figure 8:
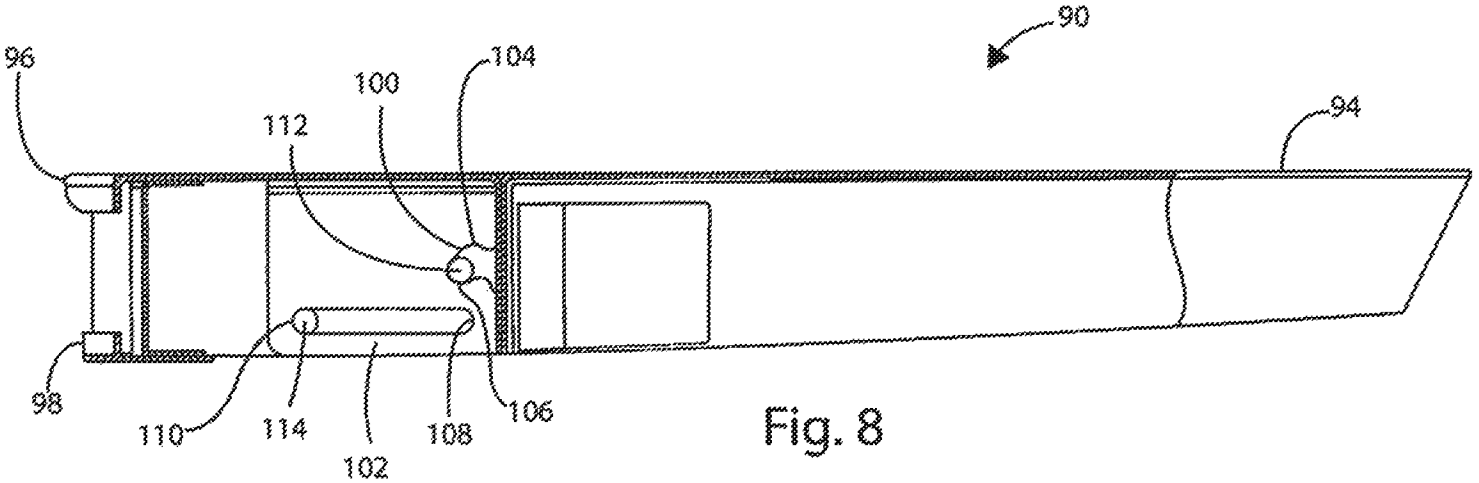
FIG. 8 is a side view of a folding shelf of the egg shaped grill assembly of the present invention showing the shelf in an extended position parallel to a ground surface.

With continued reference to FIGS. 8-11, the shelf assembly 90 of the present invention is foldable and has three predetermined positions. With reference to FIG. 8, in the first position, the shelf portion 94 is locked to the base portion 92 and the shelf portion 94 extends outwardly and parallel to a ground surface (not shown). In this position, the upper pin 112 of the base portion 92 engages the lower detent 106 of the base portion 92 and the lower pin 114 of the shelf assembly engages the rear end 110 of the lower slot 102 of the base portion 94.

Figure 9:
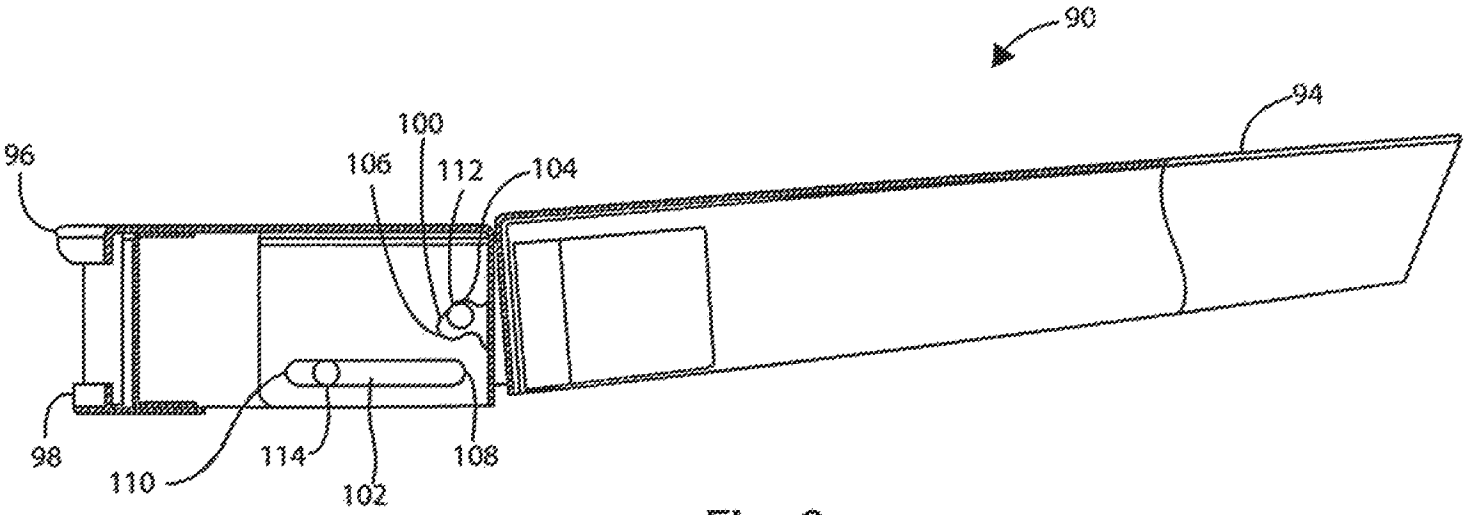
FIG. 9 is a side view of a folding shelf of the egg shaped grill assembly of the preset invention showing an shelf angled upwardly (with respect to a ground surface) in an intermediate position used for moving the grill assembly and cart.

With reference to FIG. 9, the shelf assembly 90 also has a second position where the shelf portion 94 is angled upwardly with respect to a ground surface (not shown). To put the shelf portion 94 in the second position, a user pulls the shelf portion 94 upwardly which causes the upper pin 112 of the shelf portion 94 to release from the lower detent 106 and engage the upper detent 104 of the base portion 92. The lower pin 114 of the shelf portion 94 then resides in an intermediate position in the lower slot 102 of the base portion 92.

Figure 10:
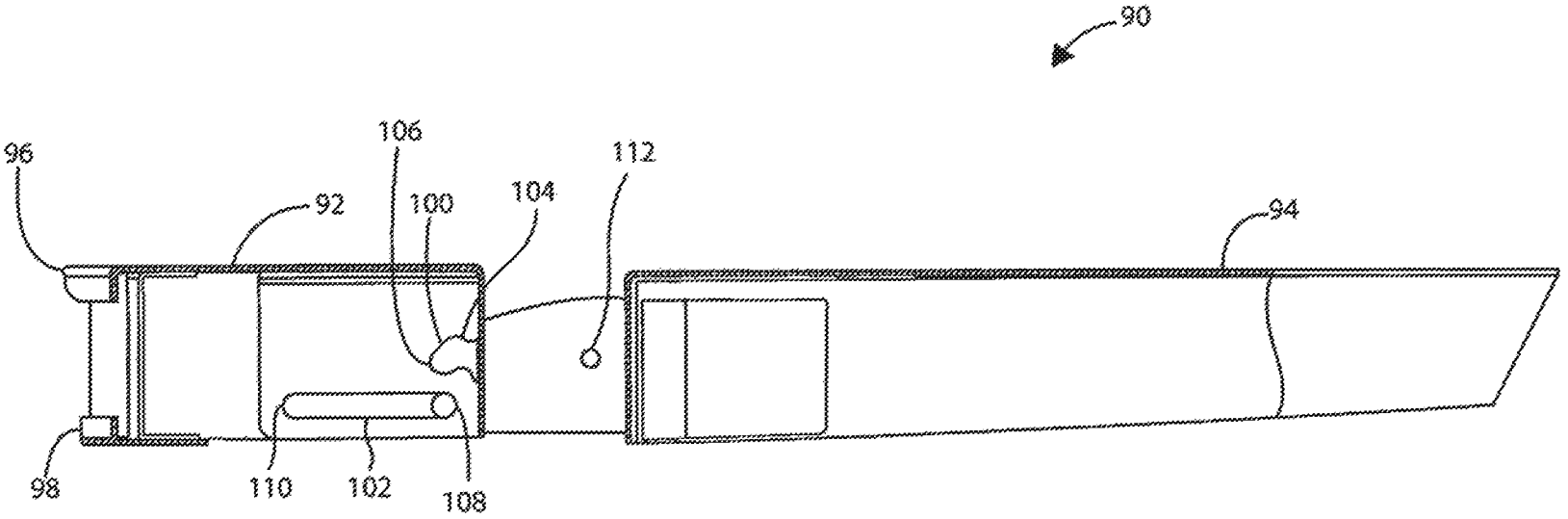
FIG. 10 is a side view of a folding shelf of the egg shaped grill assembly of the present invention showing the folding shelf in a fully extended position, prior to folding.
Figure 11:
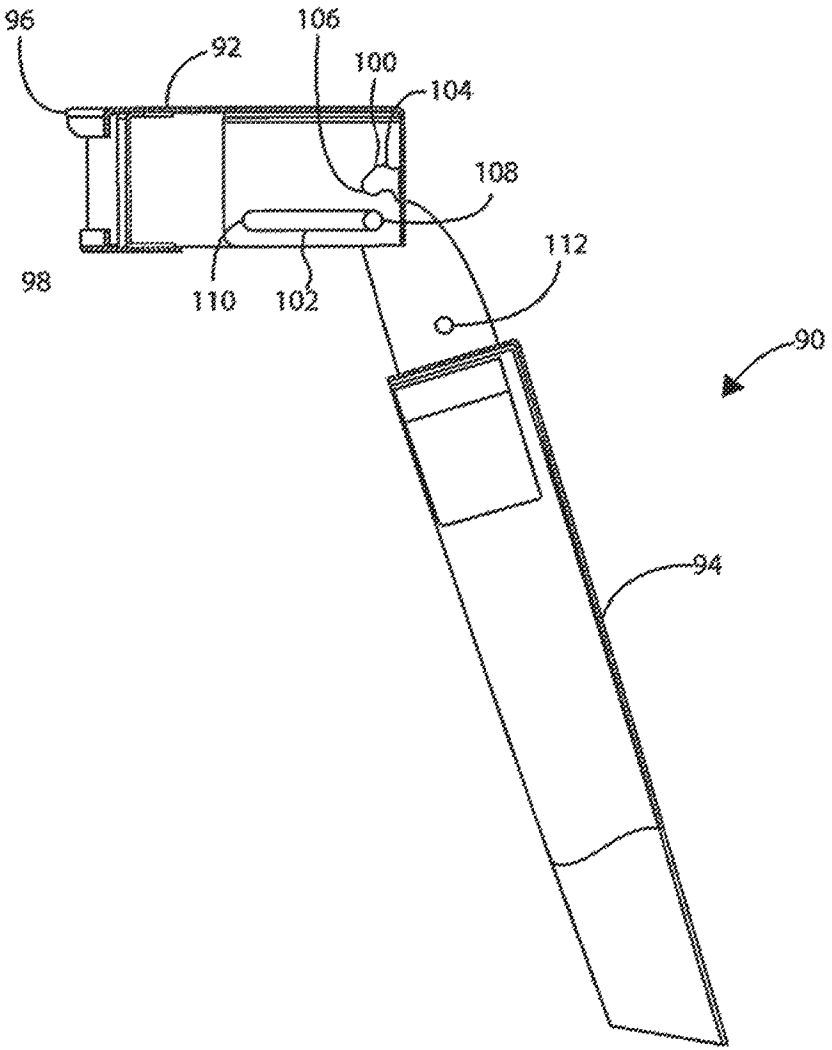
FIG. 11 is a side view of a folding shelf of the egg shaped grill assembly of the present invention showing the shelf a near fully folded position.
Figure 12:
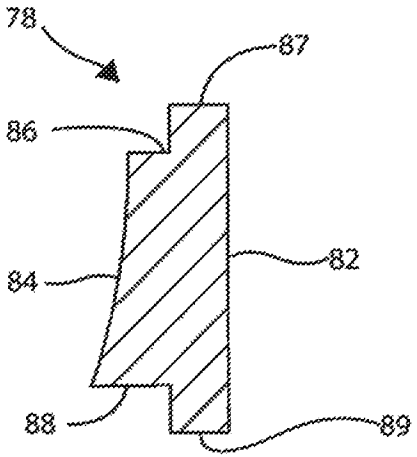
FIG. 12 is a cross-sectional view of one embodiment of a circumferential band affixed about a perimeter of the main body of the egg shaped grill assembly of the present invention.
Figure 13:
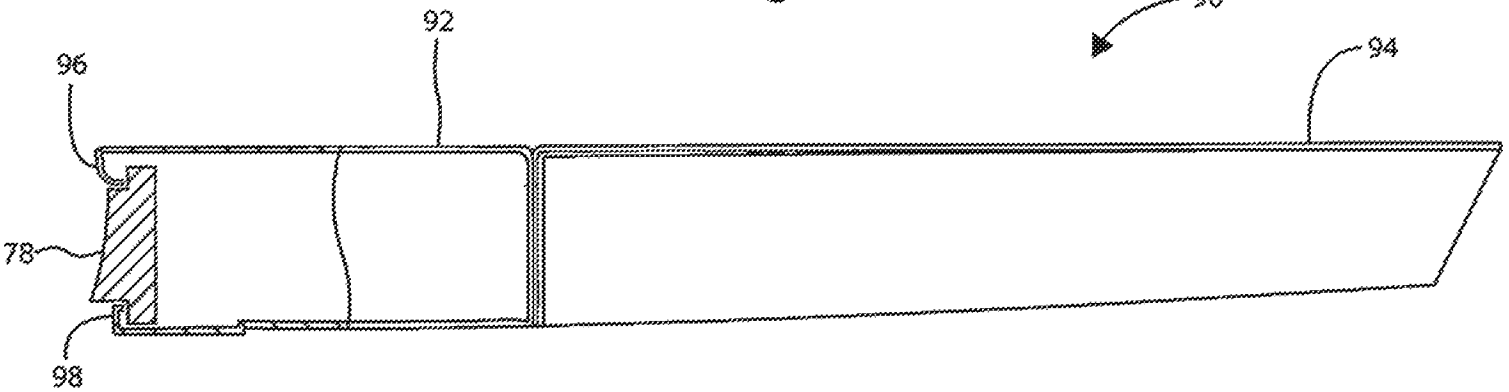
FIG. 13 is a cross-sectional view of one embodiment of a folding shelf assembly of the present invention engaged with the circumferential band of the invention.

With reference to FIGS. 10-11, the shelf assembly 90 also has a third, folded position. To put the shelf assembly 90 in the folded position a user pulls the shelf portion 94 outwardly, parallel to a ground surface. (See FIG. 10.) Pulling the shelf portion out parallel to the ground surface causes the upper pin 112 of the shelf portion 94 to release from whichever detent (104 or 106) of the base portion 92 it may be in and pulls the upper pin 112 free from the upper slot 100 of the base portion 92. At the same time, the lower pin 114 of the shelf portion 94 is pulled to the front end 108 of the lower slot 102 of the base portion 92. (See FIG. 10.) Thereafter, a user may fold the shelf portion 94 downwardly to the folded position. (See FIG. 11.) The shelf portion 94 may be folded to a position approximately perpendicular to the ground surface.

With reference to FIGS. 1-4 and 15, the cart 12 comprises a right curved grill support 116 having an upper end 118 and a lower end 120 and a left curved grill support 122 having an upper end 124 and a lower end 126. (See FIG. 3). The right curved grill support 116 and the left curved grill support 122 are interconnected near their lower ends 120, 126, by a bottom shelf 128. In the exemplary embodiment, the lower end 120 of the right curved grill support 116 is equipped with a pair of wheels 130 to provide maneuverability for the cart 12. The left curved grill support 122 is equipped with a pair of support feet 132 at its lower end 126.

With reference to FIG. 15, the upper end 118 of the right curved grill support 116 is equipped with a curved support surface 134 which matches the curvature of the main body 16 of the grill assembly 10 along a selected portion 136 of the main body 16. Likewise, the upper end 124 of the left curved grill support 122 is equipped with a curved support surface 138 which matches the curvature of the main body 16 of grill assembly 10 along a selected portion 140 of the main body 16. When assembled, the main body 14 of the grill assembly 10 is cradled within the curved support surfaces 134 and 138 of the right and left curved grill supports 116 and 122, via this interface, the grill assembly 10 is supported within the cart 12.

With continued reference to FIG. 15, a depth 144 of the main body 16 within the right and left curved grill supports 116 and 122 is controlled such that a gap 142 is maintained between the upper ends 118 and 124 of the right and left curved grill supports 116 and 122, and the circumferential lower lug 89 of the circumferential band 78. The gap 142 allows the shelf assembly 90 to freely rotate around the perimeter of the grill assembly 10 when the shelf assembly 90 is attached to the circumferential band 78. As shown in the figures, in the exemplary embodiment each grill assembly 10 is equipped with two shelf assemblies 90.

Figure 6B:
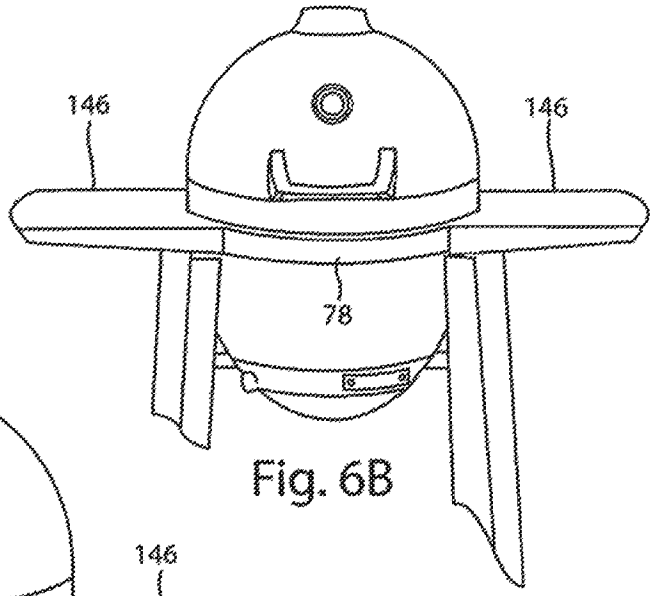
FIG. 6B is a perspective view of the egg shaped grill assembly of the present invention showing the alternative non-folding shelves installed upon the grill assembly.
Figure 6C:
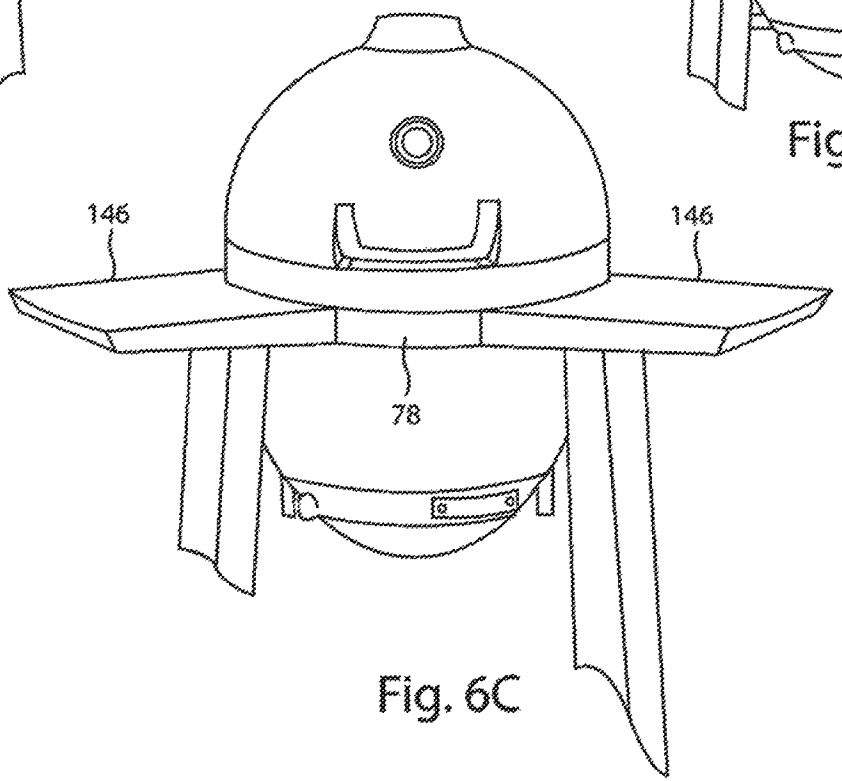
FIG. 6C is a perspective view of the egg shaped grill assembly of the present invention showing the alternative non-folding shelves rotated inwardly from the position of FIG. 6B.
Figure 6A:
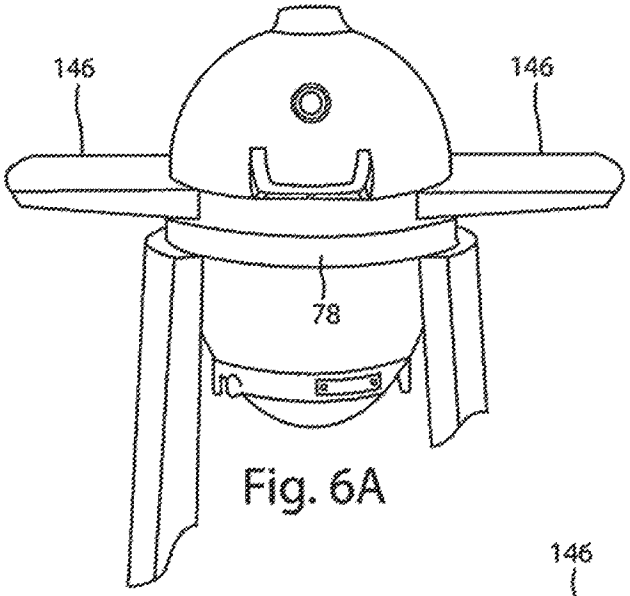
FIG. 6A is a perspective view of the egg shaped grill assembly of the present invention showing alternative non-folding shelves in a raised position for installation upon the grill assembly.
Figure 7:
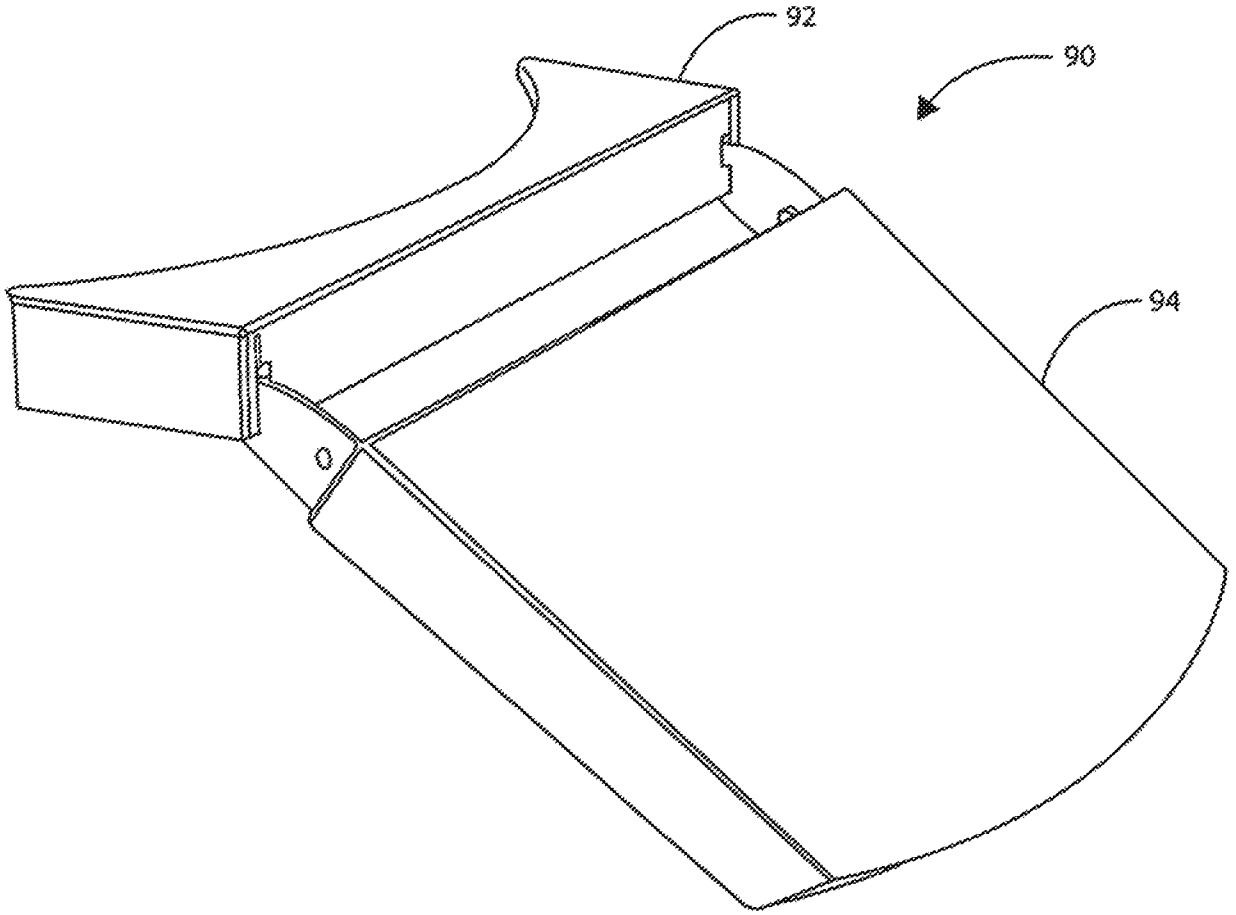
FIG. 7 is a front perspective view of a folding shelf of the egg shaped grill assembly of the present invention.

With reference to FIGS. 6A to 6C, an alternative embodiment of the shelf assembly 146 is depicted. In this alternative embodiment, the shelf assemblies 146 are non-folding. FIG. 6A depicts the alternative non-folding shelf assemblies 146 in a raised position for installation upon the circumferential band 78 of the grill assembly 10. FIG. 6B depicts the alternative non-folding shelf assemblies 146 installed upon the circumferential band 78 in a mutually opposed position. FIG. 6C depicts the alternative non-folding shelf assemblies 146 rotated inwardly from the mutually opposed position of FIG. 6B. The alternative non-folding shelf assemblies 146 attach to the circumferential band 78 in the same manner as that shown and described for the folding shelf assemblies 90.

The cart 12 and the shelf assemblies 90 and the alternative shelf assemblies 146, may be made from any number of structural thermo-plastics or like materials. The grill assembly 10 may be equipped with optional features such as a utensil holder 148, or a utensil hook 150, which attached to the circumferential band 78. (See FIG. 1.)

With reference to FIGS. 8-11, the shelf assembly 90 has three positions, in the first position the shelf assembly 90 is parallel to the ground surface and therein allows food utensils and other items to be placed on the shelf. In the second position, the shelf assembly 90 is angled upwardly with respect to the ground surface, whereby when the self assembly 90 is placed over the non-wheeled curved grill support 122 and opposite the wheeled curved grill support 116, the shelf assembly 90 can be used to lift the non-wheeled grill support 122 off the ground so the grill assembly 10 may be more readily moved about the ground surface. In the third position, the shelf assembly 90 extends downwardly and is perpendicular to the ground surface, i.e. the shelf assembly 90 is folded so as to take up less space.

The foregoing detailed description and appended drawings are intended as a description of the presently preferred embodiments of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A portable grill, comprising:

a lid, having an outer shell, an inner shell, a cavity therebetween, and a circular opening;

a main body, having an outer shell, an inner shell, a cavity therebetween, and an upper circular opening and a lower circular opening;

wherein the lid and the main body are hingedly connected at the circular opening of the lid and the upper circular opening of the main body;

an ash pan, having an outer shell, an inner shell, a cavity therebetween, and a circular opening;

wherein the ash pan is detachable from the main body, at the circular opening of the ash pan and the lower circular opening of the main body;

wherein the lid, main body and ash pan form a generally egg shaped enclosure;

a fire bowl, having a grate for supporting a solid fuel, the fire bowl being removably disposed within the inner shell of the main body;

a lower vent having an adjustable air flow opening, disposed within the ash pan;

an upper vent having an adjustable air flow opening disposed within the lid;

wherein air flow through the grill may be adjusted by means of selectively adjusting the adjustable air flow openings in the lid and the ash pan;

a circumferential band disposed about a perimeter of the main body, the circumferential band configured with an open upper channel wherein the open upper channel of the circumferential band is engageable with an inverted open upper channel of an at least one foldable shelf, wherein a flange of the inverted open upper channel of the at least one foldable shelf is located within the open upper channel of the circumferential band; and wherein the at least one foldable shelf may be rotated about the perimeter of the circumferential band;

the at least one foldable shelf including a base portion and a shelf portion, the base portion having an upper slot and a lower slot, the upper slot having an upper lock position and a lower lock position, the shelf portion having an upper pin and a lower pin, the lower pin of the shelf portion being slidable within the lower slot of the base portion, and the upper pin of the shelf portion being slidable within the upper slot of the base portion;

wherein, when the upper pin of the shelf portion engages the lower lock position of the upper slot of the base portion, the shelf portion is located in a working position generally parallel to a ground surface;

wherein, when the upper pin of the shelf portion engages the upper lock position of the upper slot of the base portion, the shelf portion is located in a position tilted upwardly with respect to the ground surface, wherein the at least one shelf may be used to assist in positioning the grill on the ground surface; and wherein, when the upper pin of the shelf portion engages neither the upper lock position nor the lower lock position of the upper slot of the base portion, the shelf portion is located in a folded position generally perpendicular with respect to the ground surface.

2. The portable grill of claim 1, wherein the cavities in the lid, main body and ash pan are filled with an insulative material.

3. The portable grill of claim 1, wherein the circumferential band further includes an open lower channel wherein the lower channel is engageable with a lower flange of the at least one foldable shelf.

4. A portable grill, comprising:

a lid, having an outer shell, an inner shell and a cavity therebetween;

a main body, having an outer shell, an inner shell and a cavity therebetween, wherein the lid and the main body are hingedly connected;

an ash pan, having an outer shell, an inner shell and a cavity therebetween, wherein the ash pan is detachable from the main body;

a fire bowl, having a grate for supporting a solid fuel, the fire bowl being removably disposed within the inner shell of the main body;

a lower vent having an adjustable air flow opening, disposed within the ash pan;

an upper vent having an adjustable air flow opening disposed within the lid; and a circumferential band configured with an open upper channel wherein the open upper channel of the circumferential band is engageable with an inverted open upper channel of an at least one foldable shelf, wherein a flange of the inverted open upper channel of the at least one foldable shelf is located within the open upper channel of the circumferential band; and wherein the at least one foldable shelf may be rotated about the perimeter of the circumferential band;

the at least one foldable shelf including a base portion and a shelf portion, the base portion having an upper slot and a lower slot, the upper slot having an upper lock position and a lower lock position, the shelf portion having an upper pin and a lower pin, the lower pin of the shelf portion being slidable within the lower slot of the base portion, and the upper pin of the shelf portion being slidable within the upper slot of the base portion;

wherein, when the upper pin of the shelf portion engages the lower lock position of the upper slot of the base portion, the shelf portion is located in a working position generally parallel to a ground surface;

wherein, when the upper pin of the shelf portion engages the upper lock position of the upper slot of the base portion, the shelf portion is located in a position tilted upwardly with respect to the ground surface, wherein the at least one shelf may be used to assist in positioning the grill on the ground surface; and wherein, when the upper pin of the shelf portion engages neither the upper lock position nor the lower lock position of the upper slot of the base portion, the shelf portion is located in a folded position generally perpendicular with respect to the ground surface.

5. The portable grill of claim 4, wherein the cavities in the lid, main body and ash pan are filled with an insulative material.

6. The portable grill of claim 4, wherein the circumferential band further includes a lower recess wherein the lower recess is engageable with a lower flange of the at least one foldable shelf.

7. The portable grill of claim 4, wherein the lid has a generally circular opening, the main body has a generally circular upper opening and generally circular lower opening, and the ash pan has a generally circular opening, wherein the generally circular opening of the lid is hingedly connected with the generally circular upper opening of the main body and the generally circular opening of the ash pan is detachably removable from the generally circular lower opening of the main body to form a generally egg shaped enclosure.

8. A portable grill, comprising:

a lid;

a main body, wherein the lid and the main body are hingedly connected;

an ash pan, wherein the ash pan is detachable from the main body;

wherein the lid, main body and ash pan form a generally egg shaped enclosure;

wherein the ash pan includes a ring shaped upper surface and the main body includes a ring shaped lower surface, wherein the ring shaped upper surface of the ash pan is removably detachable from the ring shaped lower surface of the main body; and a circumferential band disposed about a perimeter of the main body, the circumferential band configured with an open upper channel wherein the open upper channel of the circumferential band is engageable with an inverted open upper channel of an at least one foldable shelf, wherein a flange of the inverted open upper channel of the at least one foldable shelf is located within the open upper channel of the circumferential band; and wherein the at least one foldable shelf may be rotated about the perimeter of the circumferential band.

9. The portable grill of claim 8, further including a fire bowl disposed within the main body.

10. The portable grill of claim 9, further including upper and lower vents wherein the upper vent is disposed within the lid and lower vent is disposed within the ash pan.

11. The portable grill of claim 8, wherein:

the at least one shelf is a foldable shelf that includes a base portion and a shelf portion, the base portion having an upper slot and a lower slot, the upper slot having an upper lock position and a lower lock position, the shelf portion having an upper pin and a lower pin, the lower pin of the shelf portion being slidable within the lower slot of the base portion, and the upper pin of the shelf portion being slidable within the upper slot of the base portion;

wherein, when the upper pin of the shelf portion engages the lower lock position of the upper slot of the base portion, the shelf portion is located in a working position generally parallel to a ground surface;

wherein, when the upper pin of the shelf portion engages the upper lock position of the upper slot of the base portion, the shelf portion is located in a position tilted upwardly with respect to the ground surface, wherein the at least one shelf may be used to assist in positioning the grill on the ground surface; and wherein, when the upper pin of the shelf portion engages neither the upper lock position nor the lower lock position of the upper slot of the base portion, the shelf portion is located in a folded position generally perpendicular with respect to the ground surface.

12. The portable grill of claim 8, wherein the lid, main body and ash pan have inner and outer shells with cavities therebetween.

13. The portable grill of claim 8, wherein the circumferential band has an upper recess, wherein the at least one shelf has an upper flange engageable with the upper recess of the circumferential band.

14. The portable grill of claim 13, wherein the circumferential band further includes a lower recess wherein the lower recess is engageable with a lower flange of the at least one shelf.

* * * * *